US005498922A

United States Patent [19]

Chang

[11] Patent Number: 5,498,922

[45] Date of Patent: Mar. 12, 1996

[54] UNLOOSABLE AND UNTURNABLE ELECTRIC LAMP BASE SYSTEM

[76] Inventor: Ching-Hsi Chang, No. 24-2, Ta-I Li, Chu-Pei Shih, Hsin-Chu Hsien, Taiwan

[21] Appl. No.: 328,440

[22] Filed: Oct. 25, 1994

[51] Int. Cl.[6] ..... H01R 33/00

[52] U.S. Cl. ..... 313/318.1; 313/318.09; 362/249; 362/389

[58] Field of Search ..... 313/318.01, 318.09, 313/318.10; 362/249, 389

[56] References Cited

U.S. PATENT DOCUMENTS

| | | | |
|---|---|---|---|
| 4,809,143 | 2/1989 | Feger et al. | 362/249 |
| 4,962,907 | 10/1991 | Gary | 362/249 |
| 5,008,588 | 4/1991 | Nakahara | 313/318.10 |
| 5,331,529 | 6/1994 | Huang | 313/318.10 |
| 5,418,968 | 5/1995 | Wu | 362/389 |

*Primary Examiner*—Donald J. Yusko
*Assistant Examiner*—Nimesh D. Patel
*Attorney, Agent, or Firm*—Morton J. Rosenberg; David I. Klein

[57] ABSTRACT

An unloosable and unturnable lamp base system includes a lamp base with a central hole defined by a cylindrical wall provided with vertical slots, a cylindrical socket with a central upper hole for the lamp base to fit therein and with vertical ribs on inner surface to press on the outer surface of the lamp base. The slots of the lamp base provide elasticity to clamp a lamp with proper tightness when the lamp is fitted in the central hole of the base. The slots also function an escape passage for heat produced by the lamp to escape preventing the lamp from breaking caused by inflation by heat, and from loosing or rotating.

1 Claim, 2 Drawing Sheets

UNLOOSABLE AND UNTURNABLE ELECTRIC LAMP BASE SYSTEM

BACKGROUND OF THE INVENTION

A conventional electric lamp base system shown in FIG. 3 includes a lamp base 10 having a cylindrical wall 101 defining a central hole for a lamp 20 to fit therein and two opposite wire feet 102, 102 formed in a lower portion of the cylindrical wall 101 for two lead wires 201, 201 of the lamp 20 to extend through down to the bottoms of the feet 102, 102 and to bend up to contact with two conductive copper pieces 303 connected with power wires 304, 304. The system also has a cylindrical socket 30 having an upper central hole 301 for the lamp base 10 to fit therein and a lower rectangular hole 302 for the wire feet 102,102 to fit therein. Two opposite conductive copper plates 303, 303 are provided on an inner surface of the rectangular hole 302 for contacting with the two lead wires 201, 201 of the lamp 20.

In manufacturing process, the lamp base 10 often has the central hole for the lamp 20 with its size not according to the planned one caused by shooting process with cool shrinking course, consequently the lamp 20 may move or loosen therein. In addition, the socket 30 is also made by plastic shooting process, with possible different size from the preset one so that the lamp base 10 may also move or loosen in the central hole 301 of the socket 30.

SUMMARY OF THE INVENTION

In view of the disadvantage mentioned above of the conventional electric lamp base system, this invention has been devised to offer a kind of electric lamp base system, in which a lamp, a lamp base and a socket are combined together without loosening or rotating in relation to each other.

One feature of the present invention is that a plurality of vertical slots are provided in a cylindrical wall of a lamp base for providing elasticity for clamping a lamp with proper tightness, and heat produced by the lamp when lit up may disperse around through those slots out in open air.

BRIEF DESCRIPTION OF DRAWINGS

The invention will be better understood by reference to the accompanying drawings, wherein.

DESCRIPTION OF THE PREFERRED EMBODIMENTS

Figure 1:
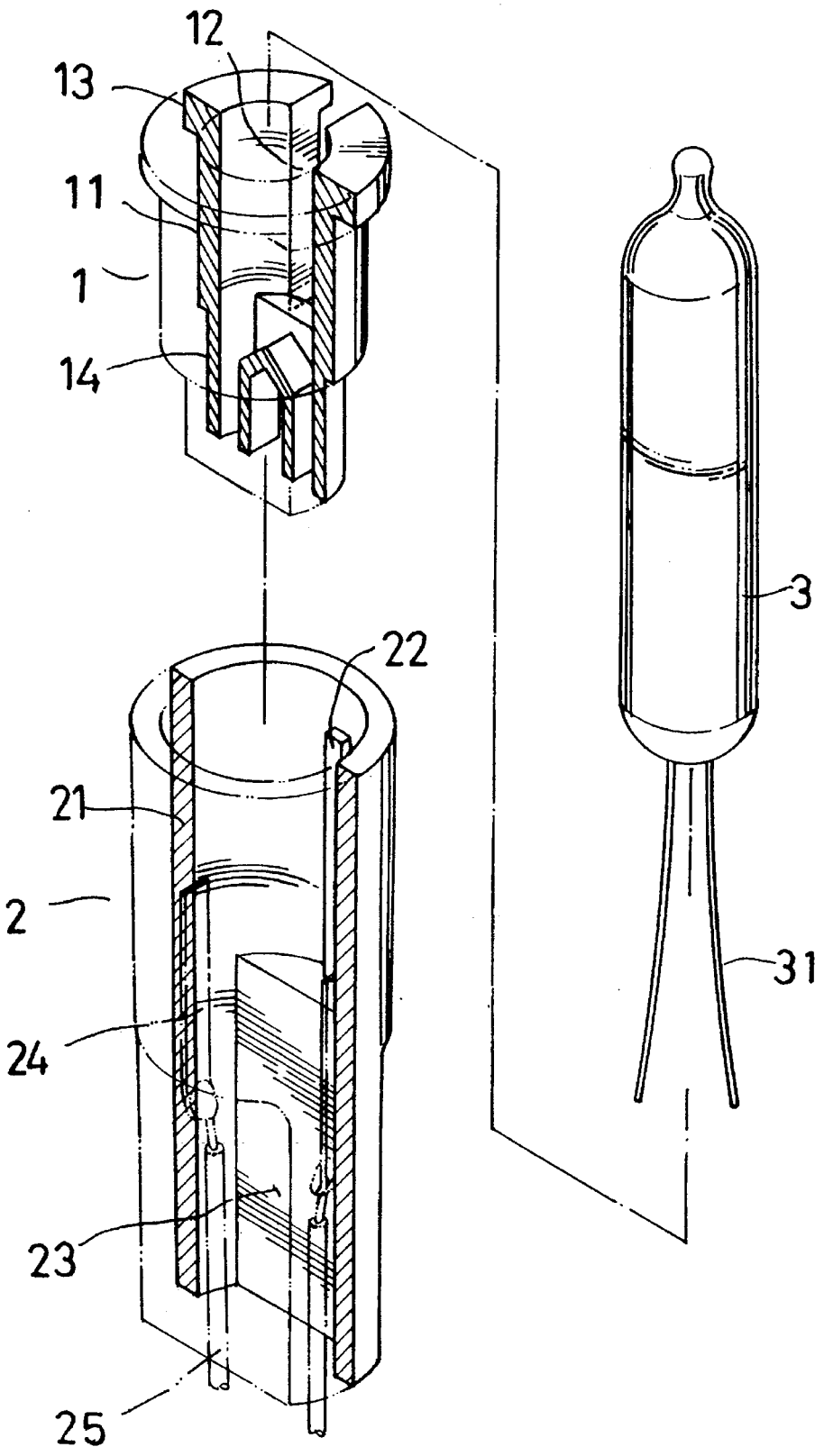
FIG. 1 is an exploded perspective view of an unloosable and unturnable electric lamp base system in the present invention.
Figure 2:
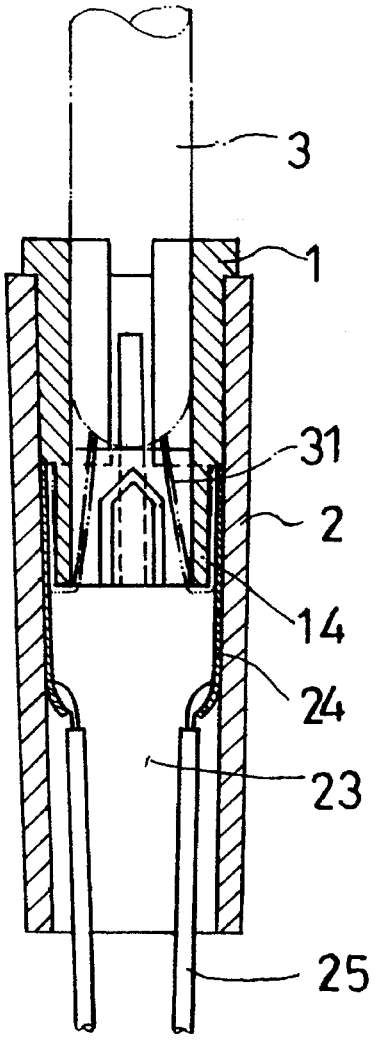
FIG. 2 is a side cross-sectional view of the unloosable and unturnable electric lamp base system in the present invention; and, FIG. 3 is a side cross-sectional view of a conventional electric lamp base system.
Figure 3:
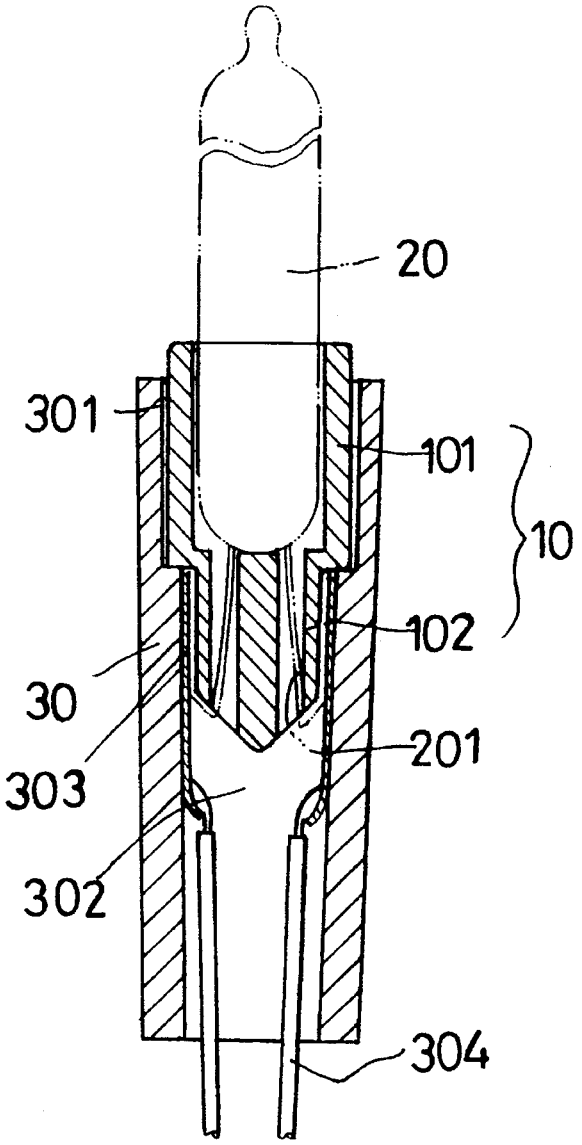
FIG. 3 (PRIOR ART)

An unloosable and unturnable electric lamp base system, especially for a Christmas lamp, as shown in FIG. 1 includes a lamp base 1, a socket 2 and a lamp 3 combined together.

The lamp base 1 has a cylindrical wall 11 defining an upper central hole, a plurality of slots 12 equally spaced in the cylindrical wall 11, and having a flange 13 at an upper end, and two vertical opposite hollow feet 14, 14 formed to extend down from the cylindrical wall for two lead wires 31 of the lamp 3 to bend up around the bottom of the feet 14, 14 so as to closely contact with two conductive plates 24, 24 lying on an inner surface of the socket 2.

The socket 2 of cylindrical form has a central upper round hole 21 for the lamp base 1 to fit closely therein, a plurality of vertical ribs 22 located equally spaced on an inner surface defining the central hole 21 for contacting with the lamp base 1 with proper tightness after the lamp base 1 is combined in the socket 2. The socket also has a central lower rectangular hole 23 for the two feet 14, 14 to be located therein.

The lamp 3 has its lower portion fitted in the upper central hole defined by the cylindrical wall 11 of the lamp base 1.

In assembling this lamp base system, at first, the lamp 3 is pushed in the upper central hole defined by the cylindrical wall 11. As the lamp 3 has a little larger diameter than that of the upper central hole, the value of looseness being commonly 0.1–0.3 mm, so that the lamp 3 may be kept tightly by means of elasticity afforded by the vertical slots 12 in the cylindrical wall 11 of the lamp base 1, with the two lead wires 31, 31 extending down to the two hollow feet 14, 14 through the upper central hole. Then the lamp 3 with the lamp base 1 together are pushed in the central upper hole 21 of the socket 2, with the ribs 22 of the socket 2 properly pressing the lamp base 1, as the diameter of the upper central hole 21 is made to be a little smaller than the outer diameter of the cylindrical wall 11 of the lamp base 1. Then there may not arise any aperture between the lamp base 1 and the socket 2 for the lamp base 1 to move or loosen out. At the same time, the two hollow feet 14, 14 just fit in the rectangular lower hole 23 of the lower portion of the socket 2 and the two lead wires 31, 31 bend up around the bottoms of the feet 14, 14 to closely contact with the two conductive copper plates 24, 24 located in the rectangular hole 23 after the lamp base 1 is combined together with the socket 2. Then two wires 25, 25 coming from power source are to be welded with the two conductive copper plates 24, 24. The lamp 3 can be clamped with proper tightness by elasticity caused by the slots 12 in the cylindrical wall 11, which can expand outward or shrink inward by the elasticity. Then this lamp with the lamp base system can satisfy GS standard, In addition, the slots 12 in the cylindrical wall 11 function as empty passages for heat produced by the lamp lit up for a considerable long period of time to disperse through out in open air. Consequently the lamp 3 and the lead wires 25, 25 may not be heated up so much, able to be used with longer service life than conventional lamp sets for Christmas decoration.

While the preferred embodiments of the invention have been described above, it will be recognized and understood that various modifications may be made therein and the appended claims are intended to cover all such modifications which may fall within the spirit and scope of the invention.

What is claimed is:

1. A lamp base system, comprising:

a longitudinally extended lamp base member having an upper cylindrically shaped wall defining a longitudinally directed central cavity, said cylindrical wall having a predetermined outer diameter and an annular flange extending around said central cavity formed at an upper edge thereof, said lamp base member having a plurality of radially equidistantly spaced slotted openings formed through said cylindrical wall, each of said plurality of slotted openings extending longitudinally through said annular flange to define elastic wall portions extending between said plurality of slotted openings;

a lamp disposed within said cavity; and, a socket member having a cylindrical wall defining a central longitudinally directed opening for receiving said lamp base member therein, said cylindrical wall of said socket member having a plurality of radially equidistantly spaced ribs extending inwardly from an inner surface thereof for engaging respective elastic wall portions, said plurality of inwardly extending ribs defining opening having a diameter less than said predetermined outer diameter of said lamp base member cylindrical wall for displacing said elastic wall portions to clampingly secure said lamp within said cavity of said lamp base member and to secure said lamp base member within said central opening of said socket member.

* * * * *